US010584855B1

(12) United States Patent
Drost et al.

(10) Patent No.: US 10,584,855 B1
(45) Date of Patent: Mar. 10, 2020

(54) APPARATUS, METHOD, AND SYSTEM FOR A COMPACT MODULAR LED LIGHTING SOURCE AIMABLE ON MULTIPLE INDEPENDENT AXES

(71) Applicant: Musco Corporation, Oskaloosa, IA (US)

(72) Inventors: Matthew D. Drost, Oskaloosa, IA (US); Thomas A. Stone, University Park, IA (US)

(73) Assignee: Musco Corporation, Oskaloosa, IA (US)

( * ) Notice: Subject to any disclaimer, the term of this patent is extended or adjusted under 35 U.S.C. 154(b) by 763 days.

(21) Appl. No.: 15/097,674

(22) Filed: Apr. 13, 2016

Related U.S. Application Data

(60) Provisional application No. 62/214,356, filed on Sep. 4, 2015, provisional application No. 62/147,203, filed on Apr. 14, 2015.

(51) Int. Cl.

| | |
|---|---|
| ***F21S 4/00*** | (2016.01) |
| ***F21V 14/02*** | (2006.01) |
| ***F21V 31/03*** | (2006.01) |
| *F21Y 101/02* | (2006.01) |
| *F21Y 105/00* | (2016.01) |

(52) U.S. Cl.
CPC ..... *F21V 14/02* (2013.01); *F21V 31/03* (2013.01); *F21Y 2101/02* (2013.01); *F21Y 2105/001* (2013.01)

(58) Field of Classification Search
CPC ..... F21Y 2115/10; F21Y 2103/10; F21Y 2101/00; F21V 21/30; F21V 14/02; F21V 29/004; F21V 29/763; F21V 19/001; F21V 21/14; F21V 29/74; F21V 5/04; F21W 2131/105; F21W 2131/103; F21K 9/20; Y10T 29/49826
USPC ..... 362/249.03
See application file for complete search history.

(56) References Cited

U.S. PATENT DOCUMENTS

| | | | | |
|---|---|---|---|---|
| 8,256,921 | B2 | 9/2012 | Crookham et al. | |
| 8,356,916 | B2 | 1/2013 | Gordin et al. | |
| 8,449,144 | B2 | 5/2013 | Boxler et al. | |
| 8,622,569 | B1 | 1/2014 | Crookham et al. | |
| 9,581,303 | B2 * | 2/2017 | Gordin | F21S 8/086 |
| 2013/0050996 | A1 * | 2/2013 | Holscher | F21S 9/022 362/184 |

* cited by examiner

*Primary Examiner* — Thien M Le
*Assistant Examiner* — Tae W Kim
(74) *Attorney, Agent, or Firm* — McKee, Voorhees & Sease, PLC

(57) ABSTRACT

An apparatus, method, and system for a flexible approach to lighting design is discussed including temporary lighting designs, target areas with changing requirements, or tamper- and environmentally-resistant ground-mounted lighting fixtures for architectural or aesthetic lighting. Envisioned are fixtures typically comprising multiple compact LED modules mounted in one or more rows in a compact frame, capable of independent adjustment about at least two axes, having a wide range of aiming angles from a common pivotable joint, and preserving a thermal dissipation path regardless of aiming angle.

8 Claims, 17 Drawing Sheets

Section A – A

Section A – A

Section B – B

APPARATUS, METHOD, AND SYSTEM FOR A COMPACT MODULAR LED LIGHTING SOURCE AIMABLE ON MULTIPLE INDEPENDENT AXES

CROSS-REFERENCE TO RELATED APPLICATIONS

This application claims priority under 35 U.S.C. § 119 to provisional application Ser. No. 62/147,203 filed Apr. 14, 2015 and provisional application Ser. No. 62/214,356 filed Sep. 4, 2015, all of which are herein incorporated by reference in their entirety.

BACKGROUND OF THE INVENTION

The invention generally relates to aimable LED products. More specifically, the present invention relates to LED products which can be aimed or adjusted or which can have optical properties changed within a mounted luminaire.

Fixtures having aimable LED optics are known in the industry. They have been developed because of a need to adjust and customize lighting to a desired target and for a desired effect. However, there is still room for improvement in the art.

Fixtures having "aimable optics" have certain needs in common with standard lighting fixtures, including creating light that is distributed evenly on the object and at adequate levels, and having good cut-off characteristics to reduce or eliminate glare. Further, fixtures should have good thermal management characteristics to provide optimum LED efficacy and longevity, should be protected against theft or vandalism, and if used outdoors they should be protected against damage from weather conditions.

Fixtures having "aimable optics" often have additional needs, since they are frequently used for non-standardized locations and applications, such as for temporary lighting, facade lighting, lighting for building faces, signs, displays, etc. Lighting needs for these locations may be poorly understood until the lighting is installed, or requirements may change based on trial installation of lighting or for other reasons. The target buildings, objects, or areas can be very tall, wide, or irregularly shaped. They may have special requirements for placement of light sources due to functional or aesthetic conditions. Thus there is often need for specific light beam configurations.

Further, aesthetic considerations can make it desirable to change color output of fixtures, e.g., by installing colored lenses or color "gels". Still further, fixtures may be used in applications such as broadcasting or photography which can require very high quality lighting. Thus these fixtures benefit from being highly adjustable to adapt to these applications.

Thus there is a well-known need in the art for lighting fixtures which are highly adjustable and can create different beam configurations, for lighting fixtures which can change colors or lenses, and for lighting fixtures that can be easily and rapidly configured on site while remaining secure from tampering or environmental damage.

A few examples of aimable lighting fixtures according to the art can be found in U.S. Pat. No. 8,356,916, No. 8449144, No. 8256921 and No. 8622569 each of which is incorporated by reference in its entirety. The first two of these patents disclose fixtures that are adjustable or aimable in basically one dimension, which is insufficient for many special lighting applications. The second two of these patents disclose fixtures which are more adjustable but still have significant deficiencies for the types of lighting applications being discussed. They have a significant degree of aimability, but are not well-adapted for use as building lights or for placement in difficult locations or on the ground. Further, the adjustments are not readily accessible or convenient.

Thus there is still need for improvement in the art.

SUMMARY OF THE INVENTION

Embodiments of the present invention provide for an apparatus, system, and method for creating a lighting source with aimable LED lighting elements for use in a compact luminaire. It is therefore a principle object, feature, advantage, or aspect of the present invention to improve over the state of the art and/or address problems, issues, or deficiencies in the art.

Further objects, features, advantages, or aspects of the present invention may include one or more of the following:

In one aspect of the invention an LED lighting apparatus comprises an overall housing and a plurality of LED subassemblies in the housing. Each LED subassembly emulates a ball-in-socket relationship with a receiver or seat. The LED subassembly includes at least one LEI) light source and a lens. The ball-in-socket arrangement, at least in part, allows rotation of the LED subassembly both to change angular aiming direction of the LED at least over a range as well as rotation of the LED around its aiming axis. The combination therefore allows highly adjustable individual LED subassemblies in a lighting fixture tbr highly controllable light output from the fixture. It also allows selectable interchangeability of LEI) subassemblies and components of the subassemblies. A removable member allows the ball-in-socket subassemblies to be fixed or locked into place in the housing in a selected rotation orientation.

A method, system, and apparatus for lighting a target according to aspects of the present invention comprises a fixture capable of providing directional lighting including, but not limited to, ground-mounted facade lighting. It further comprises a plurality of LED modules which are adjustable in two or three axes, which can optimally preserve good thermal transfer between the light source and the exterior of the module housing regardless of aiming angle, which are environmentally sealed either individually or by a common lens, and which further are readily accessible from the front, or are able to avoid damage from environmental factors. Said fixture allows, for example, a technician to switch out failed LEDs, add a diffuser to effectuate a different beam pattern, add or change gels, etc., thereby promoting rapid in situ adjustability over the state of the art. It further allows significant flexibility in lighting design. Still further it can actually allow higher driver currents to LEDs with enhanced thermal transfer, in comparison with existing art, more efficiently dissipating heat from the light source to the exterior of the module housing regardless of aiming angle.

A further method, system, and apparatus for lighting a target according to aspects of the present invention comprises a compact lighting source having a plurality of LED modular light sources or modules and a mounting frame. The modules pivot on one or more axes which are within the outline of the module such that the modules rotate about intersecting or nearly intersecting axes, and are mounted between a mounting frame comprising two clamping elements. The clamping elements together create a cylindrical or partially cylindrical cavity. Alternatively, they have structural elements oriented in a generally cylindrical configuration. Each clamping element has an internal cavity which comprises a generally cylindrical section, wherein at least the upper partially-cylindrical element has an opening to allow light from the LED module to be directed toward a target. Said clamping elements hold the LED modules while allowing the modules to be individually aimed, and further hold the aiming of the modules permanently or until re-aiming is desired. Clamping is accomplished, e.g., by variably tightening screws or fasteners or providing other tightening means well-known in the industry; alternatively, a single tightness level could provide a holding force that would allow adjustment but prevent inadvertent loss of adjustment.

The mounting frame further may be mounted within a housing or luminaire, or may itself comprise, partially comprise, or be part of a housing or luminaire capable of being affixed to a mounting location.

The modules can be adjusted independently relative each other and relative the luminaire, so that a single compact luminaire, using the described compact lighting source, can provide a very wide range of aiming without interference between individual lighting sources aimed in different directions. To accomplish this, there are two axes of rotation relating to the LED module. These axes of rotation intersect or nearly intersect approximately in the center of the module, and are approximately perpendicular to the optic axis of the LED. The entire LED module rotates about a first axis of rotation, coaxially with the cylindrical clamping cavity in the mounting frame.

The module further can comprise a capsule containing the LED and associated components, and two generally cylindrical mounting segments. Said mounting segments have a common axis which serves as one axis of rotation for the LED module. In other words, as previously described, the entire module comprising the capsule with associated segments rotates within the mounting frame about one axis of rotation. Further, the capsule also pivots within the two mounting segments about a second axis of rotation.

Said modules can be mounted within the mounting frame coaxially with respect to a first axis of rotation. Said modules are each capable of being rotated independently about each axis on the order of 30 to 45 degrees from their central point, and further are capable of being rotated independently of the rotation of the other modules within the luminaire, such that the extent of rotation about one axis does not affect the extent of rotation about the other axis.

A further aspect of the invention comprises multiple LED modules which are mounted in groups which are compactly mounted in close proximity where two or more modules are mounted coaxially about one common axis of rotation, and where two or more modules are similarly mounted coaxially about an axis of rotation which is more or less parallel to the common axis of rotation of the first group of two or more modules.

These and other objects, features, advantages, or aspects of the present invention will become more apparent with reference to the accompanying specification and claims.

BRIEF DESCRIPTION OF THE DRAWINGS

From time to time in this description reference will be taken to the drawings which are identified by figure number and are summarized below.

FIG. 9 illustrates a perspective view and FIG. 10 illustrates a partially exploded perspective view.

FIG. 11A illustrates module 100 with lens 108 as the primary optic and FIG. 11B illustrates module 100 with reflector 114 as the primary optic.

DETAILED DESCRIPTION OF EXEMPLARY EMBODIMENTS

A. Overview

Figure 1:
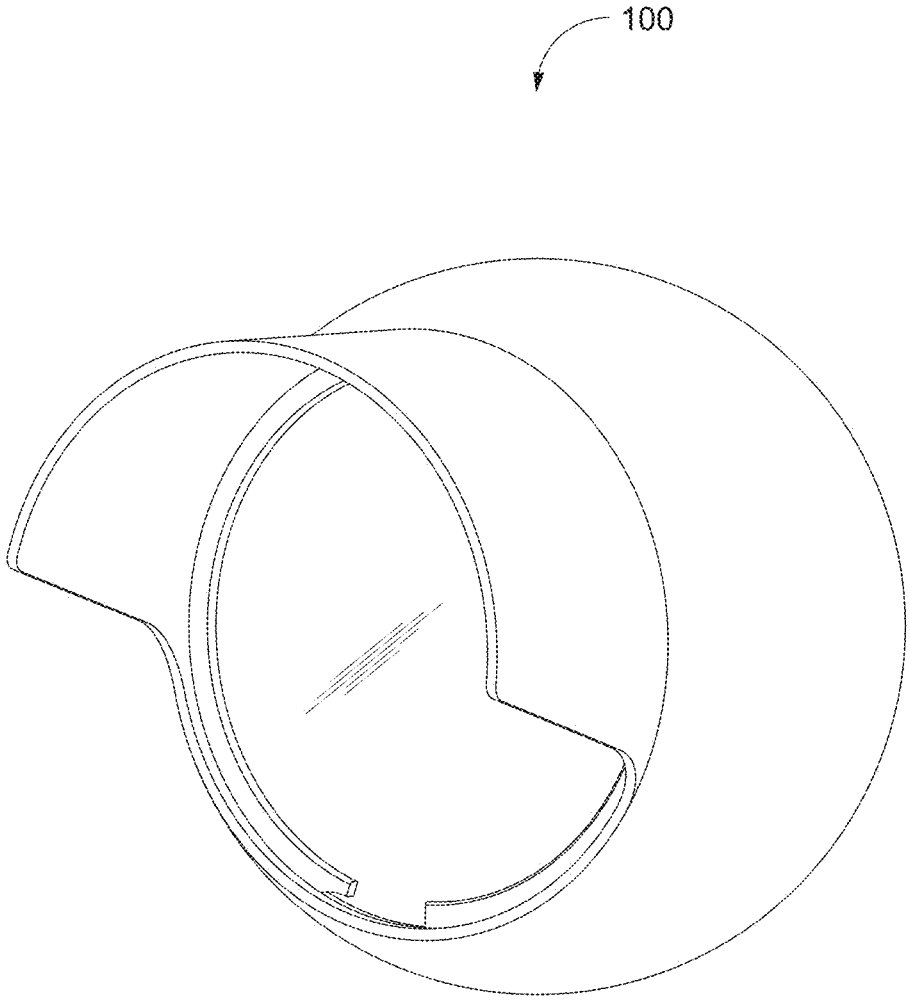
FIGS. 1-8 illustrate an LED module according to aspects of the invention in isometric, front, back, left side, right side, top, bottom, and exploded isometric views, respectively.

Specific exemplary embodiments according to the present invention will be described in detail herein. Frequent mention will be made in this description to the drawings. Reference numbers will be used to indicate certain parts in the drawings. Unless otherwise stated, the same reference numbers will be used to indicate the same parts throughout the drawings. For the sake of clarity, power distribution sources (e.g., line power, battery), power regulating components (e.g., driver), and power wiring (e.g., electrical connections between an LED and the board upon which it is mounted, wiring from each LED module to power regulating components) have frequently been omitted from the drawings. Basic electrical wiring of light sources is assumed to be known to a person having ordinary skill in the art of lighting design.

The term "optic" or "optics" is used throughout and is generally defined as devices which may or may not be light transmissive and which modify the light output of one or more light sources. Some examples include lenses, reflectors, visors, diffusers, and color "gels" which modify the color of the light projected from an LED module. Likewise, the terms "fixture" and "luminaire" are used interchangeably herein; either term is generally defined as the combination of a light source, housing, optics, and electrical connections. Neither term is intended to convey a particular arrangement of features common in lighting design. The term "lighting designer" used herein is included for convenience without limiting who may practice aspects of the invention or lighting design in general.

B. Exemplary Method and Apparatus Embodiment 1

Figure 2:
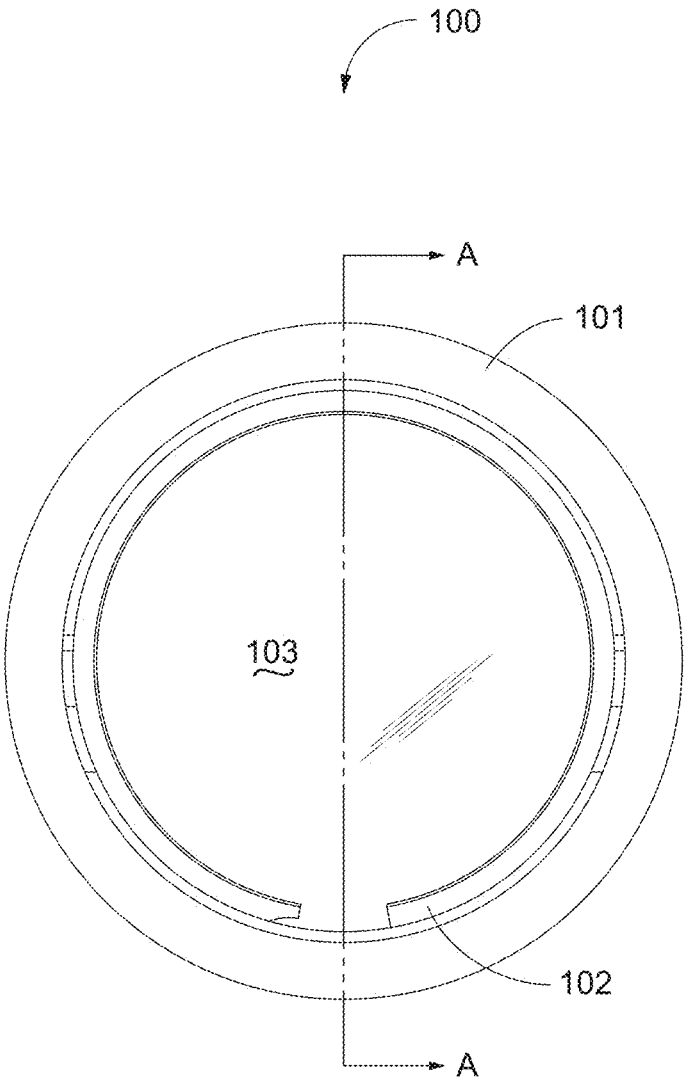
Figure 3:
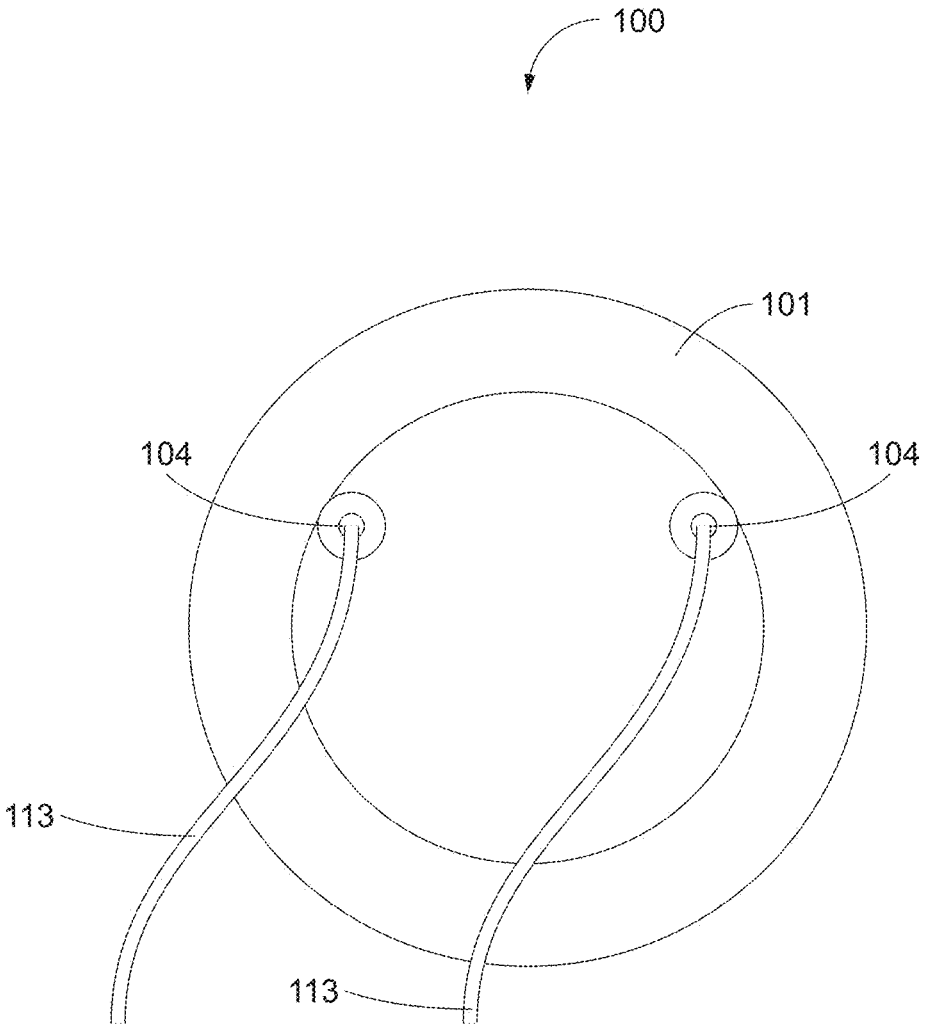
Figure 4:
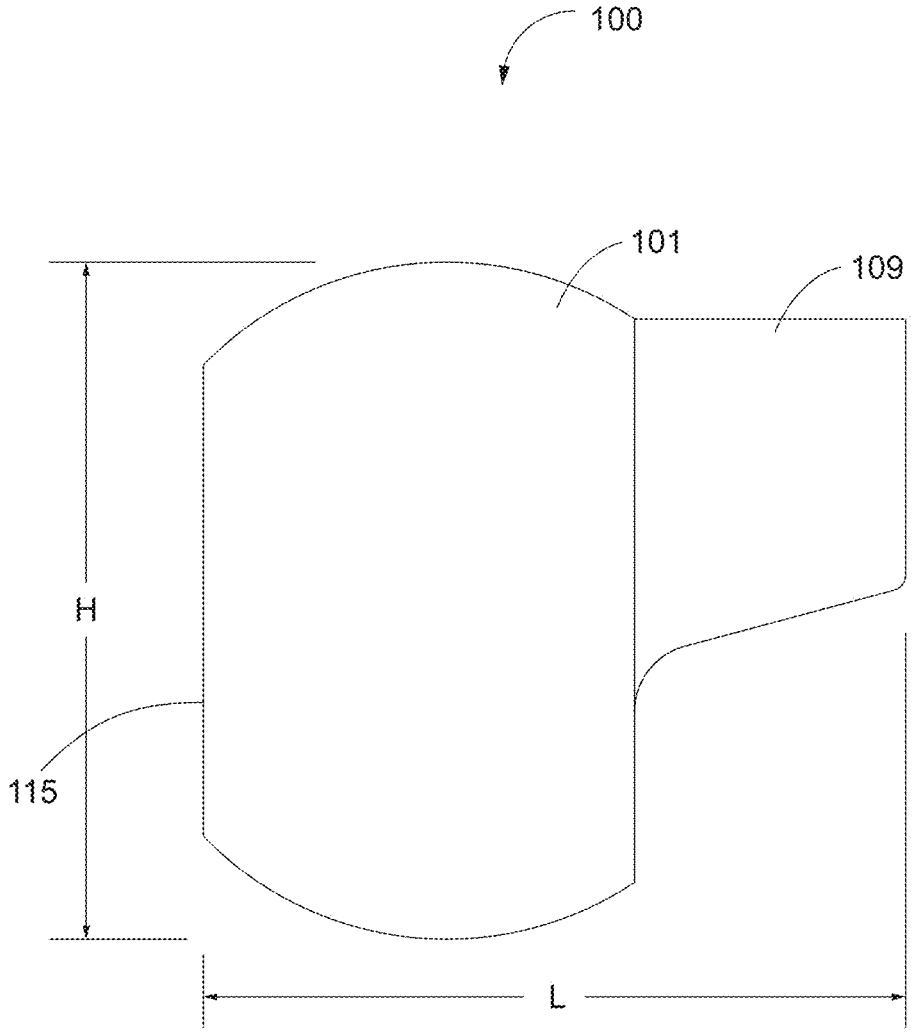
Figure 5:
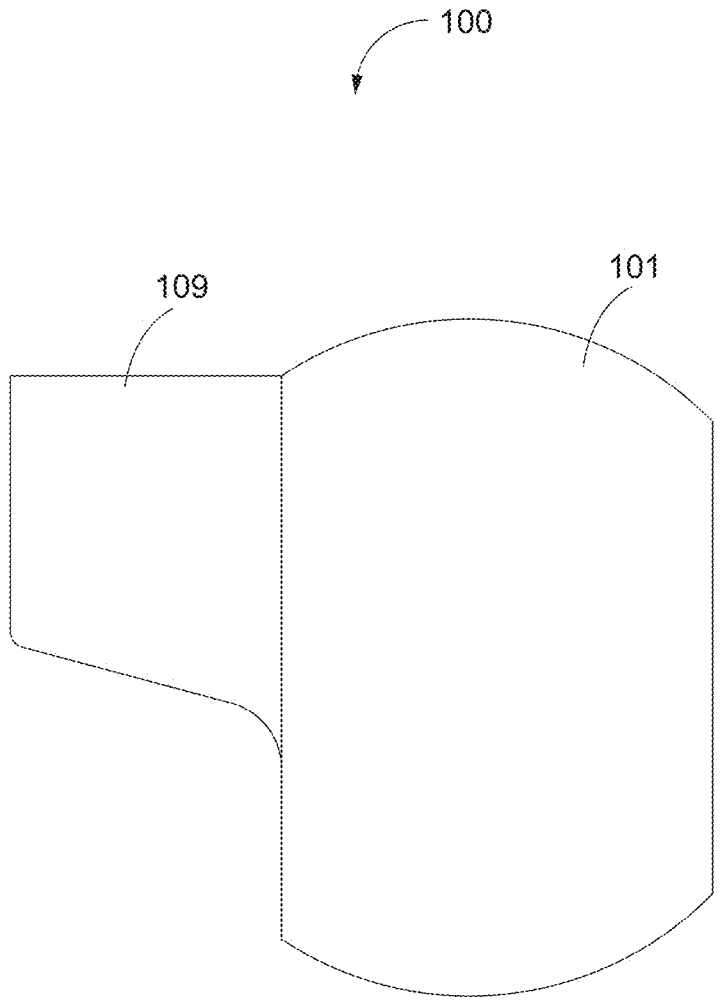
Figure 6:
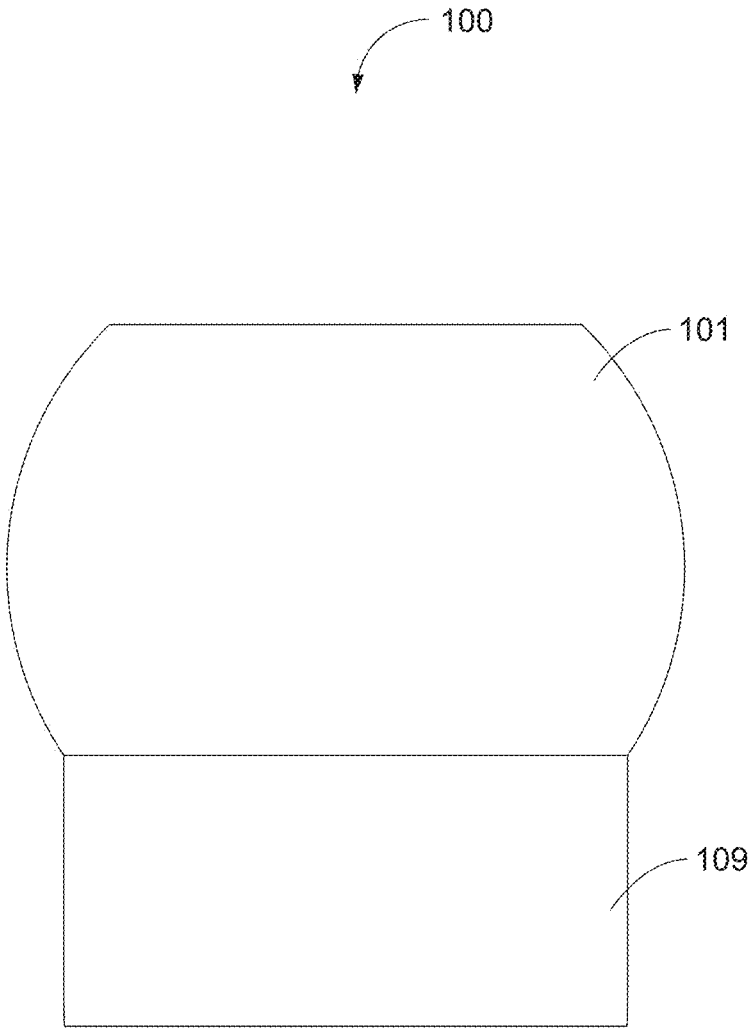
Figure 7:
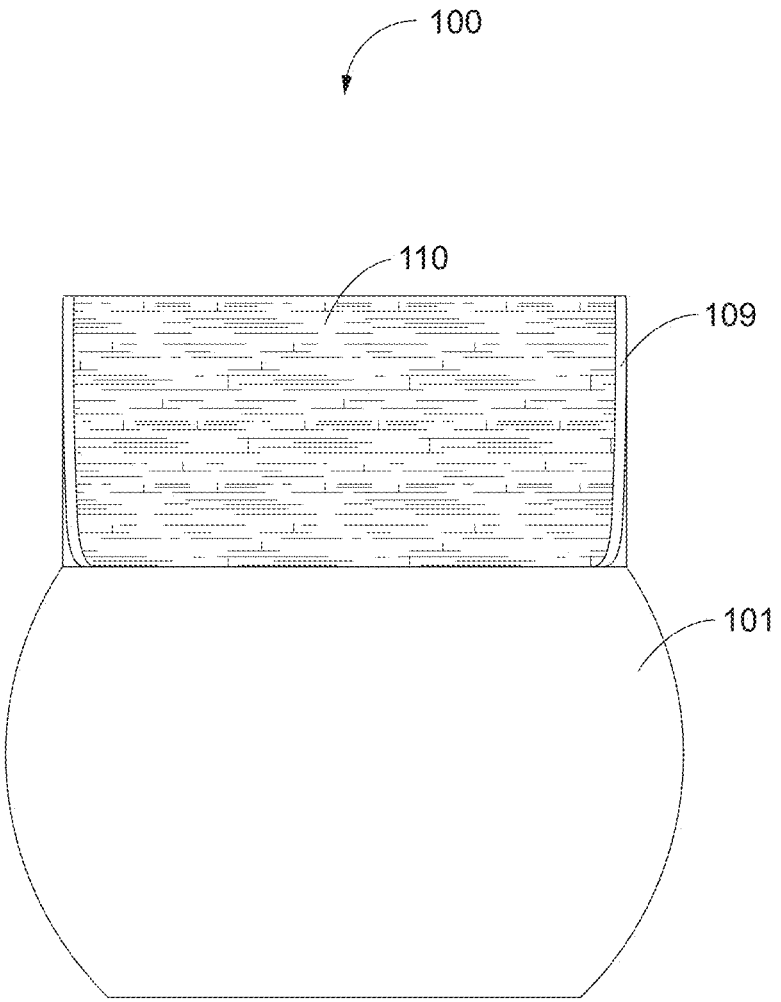
Figure 8:
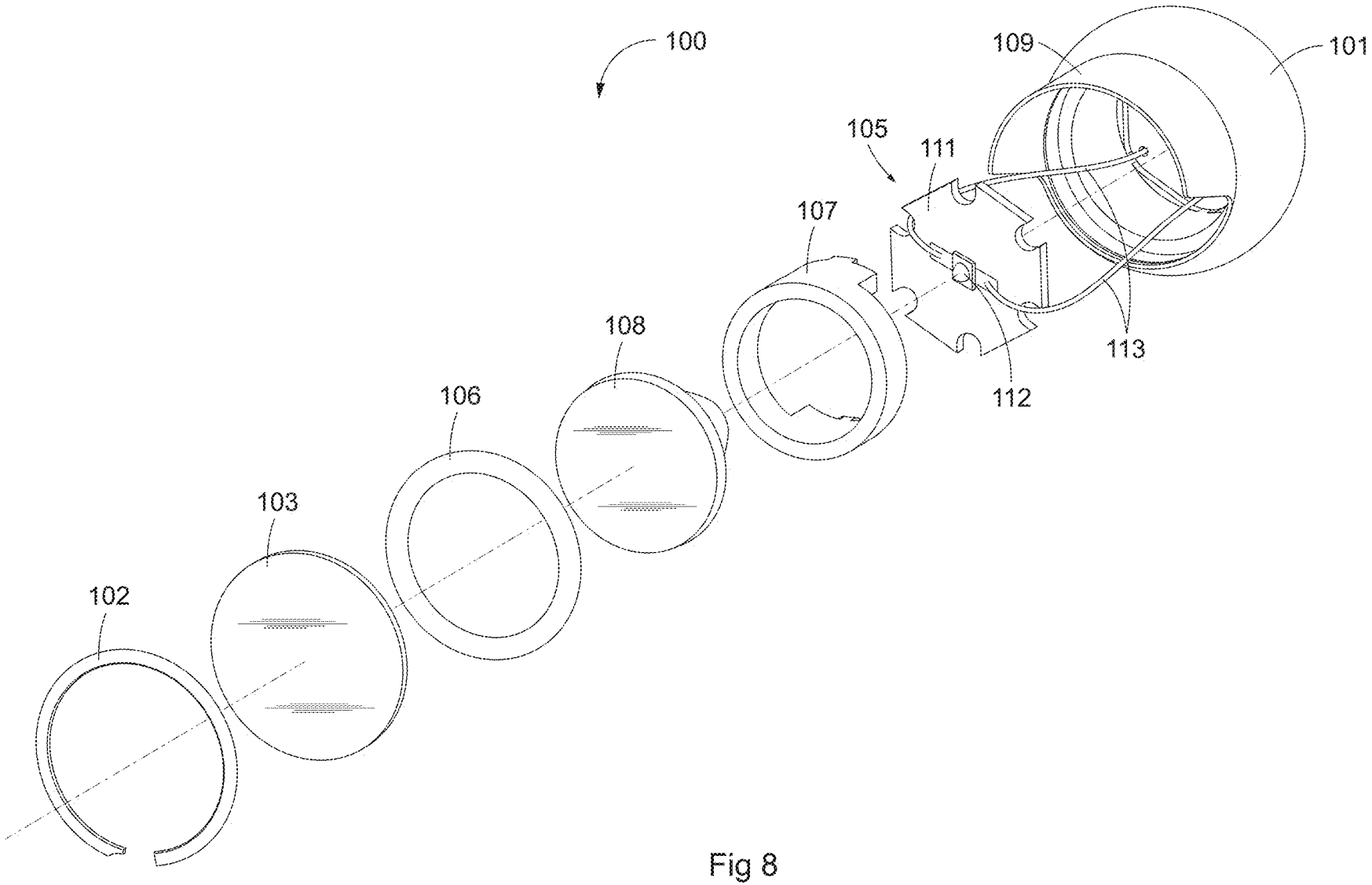

FIGS. 1-8 illustrate various views of an LED module 100 according to an embodiment of the present invention. Module 100 generally comprises a thermally conductive housing 101 having dimensions H and L on the order of 1.25" (FIG. 4). A flat face 115 on the back of housing 101 (FIG. 3) includes holes 104 to accommodate LED power wiring run into the hollow interior of housing 101. Quick disconnect connectors for power wiring 113, FIGS. 3 and 8 could be used. This would aid switching out entire modules. A flat face on the front of housing 101 (FIG. 2) includes a visor 109 (FIGS. 4-7), (ii) an opening into the hollow interior of housing 101 readily accessible by a lighting designer (FIG. 8), and (iii) a stepped or tapered profile from the outer surface of housing 101 to the hollow interior to accommodate O-ring 106, lens 103, and snap ring 102 (FIGS. 2 and 8). The visor-like portion 109 of housing 101 of module 100 cuts off light to define beam dimensions and to prevent the light from one module striking another module when installed in a luminaire. The face 110 of visor 109, FIG. 7, may have a coating or texture (see hatching at 110 in FIG. 7) to absorb, reflect or otherwise interact with light projected from LED 105. Such coatings or textures are well-known to those skilled in the art. Lens 103, FIGS. 8 and 11A-B of module 100 protects internal optics and could also serve as a substrate upon which color gels, diffuser sheets, etc. could be adhered. Snap ring 102 compresses lens 103 against O-ring 106. O-ring 106 seals opening of housing 101. Snap ring 102 further allows accessibility to change diffusers, lenses, LEDs, etc. Note that modules 100 used in a common fixture may be of similar or identical design, or may use internal components such as LEDs and lenses of differing design in order to provide desired lighting characteristics, such that each module may have independently selectable and adjustable optical properties.

Module 100 further comprises a number of components internal to housing 101; see FIG. 7. An LED board 105 comprising LED 112 and substrate 111 is installed in the interior of housing 101 against the interior side of the back flat face (see FIG. 11A) to provide a direct path for dissipating the heat at the LED junction. This helps to preserve efficacy and operating life of the LED, Cree model XM-L is configured in what is referred to as a star board arrangement and is available from Cree, Inc., Durham, N.C., USA. Other LED types and configurations are possible.

Machined flats in the interior of housing 101 orient LED board 105 within the housing and provide for routing of wiring out holes 104. Gaps between holes 104 and wiring of LED board 105 may be filled with silicone sealer or other material. An optics holder 107 is installed proximate LED 105 such that optic 108 when seated in optics holder 107 at least partially surrounds LED 105 to modify the properties of the light emitted from LED 105. In this embodiment optic 108 comprises a narrow beam lens with an 18 degree beam spread. Other configurations with different specifications are possible and envisioned as well.

Figure 11A:
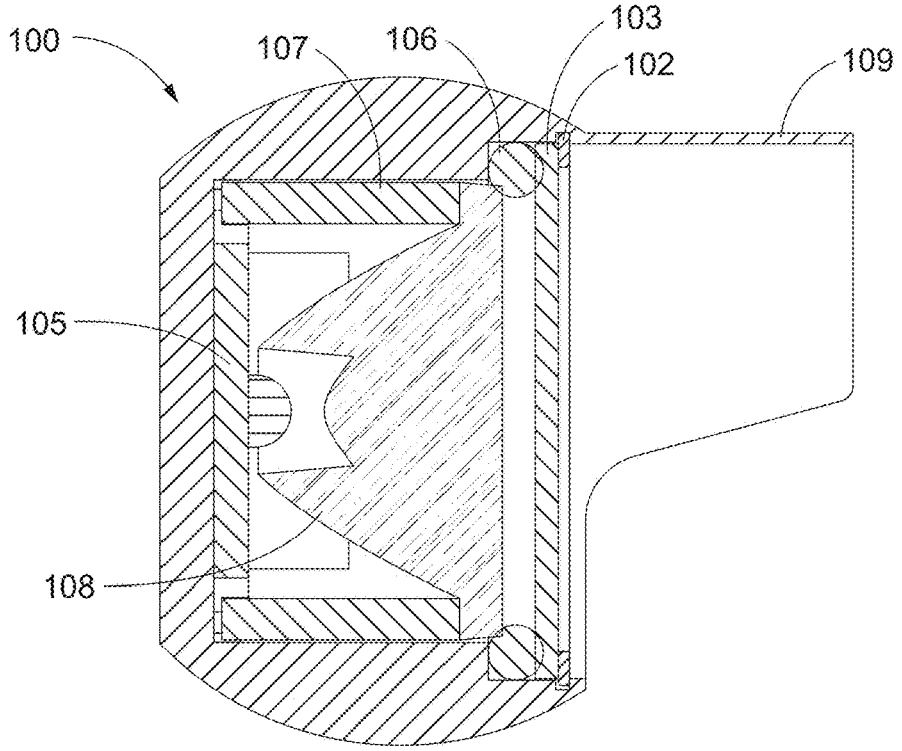
FIGS. 11A-B illustrate a section view of module 100 taken along line A-A of FIG. 2.
Figure 11B:
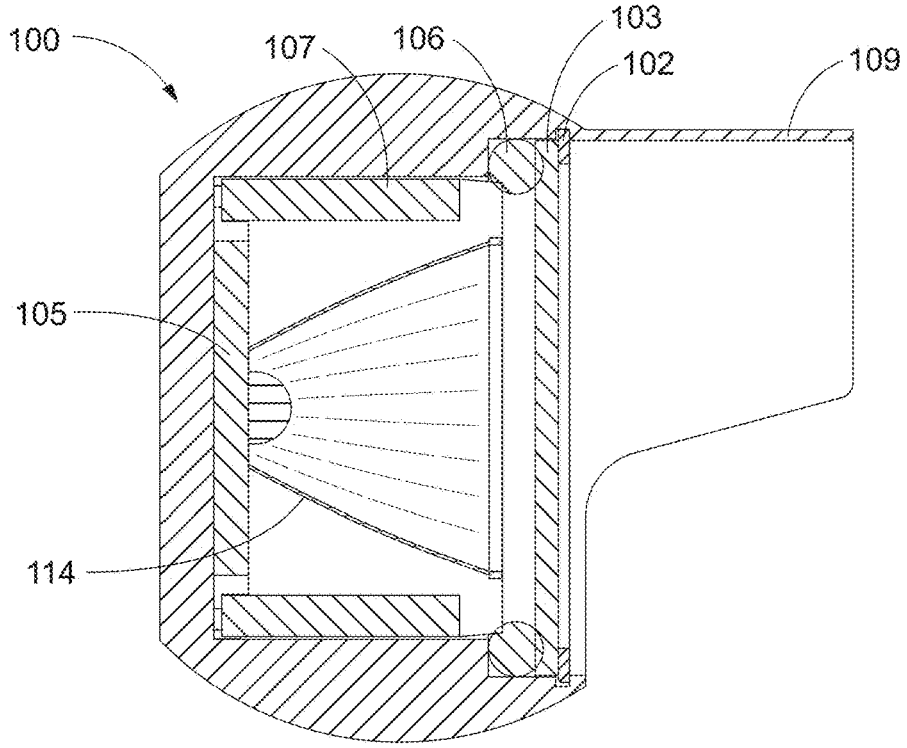

Machined tabs on the bottom of optics holder 107 fit into slots of the star board arrangement, see FIG. 11A. O-ring 106 cooperates with lens 103 and snap ring 102 to provide removable sealing of LED module 100, and to hold internal components in place by compression.

Figure 9:
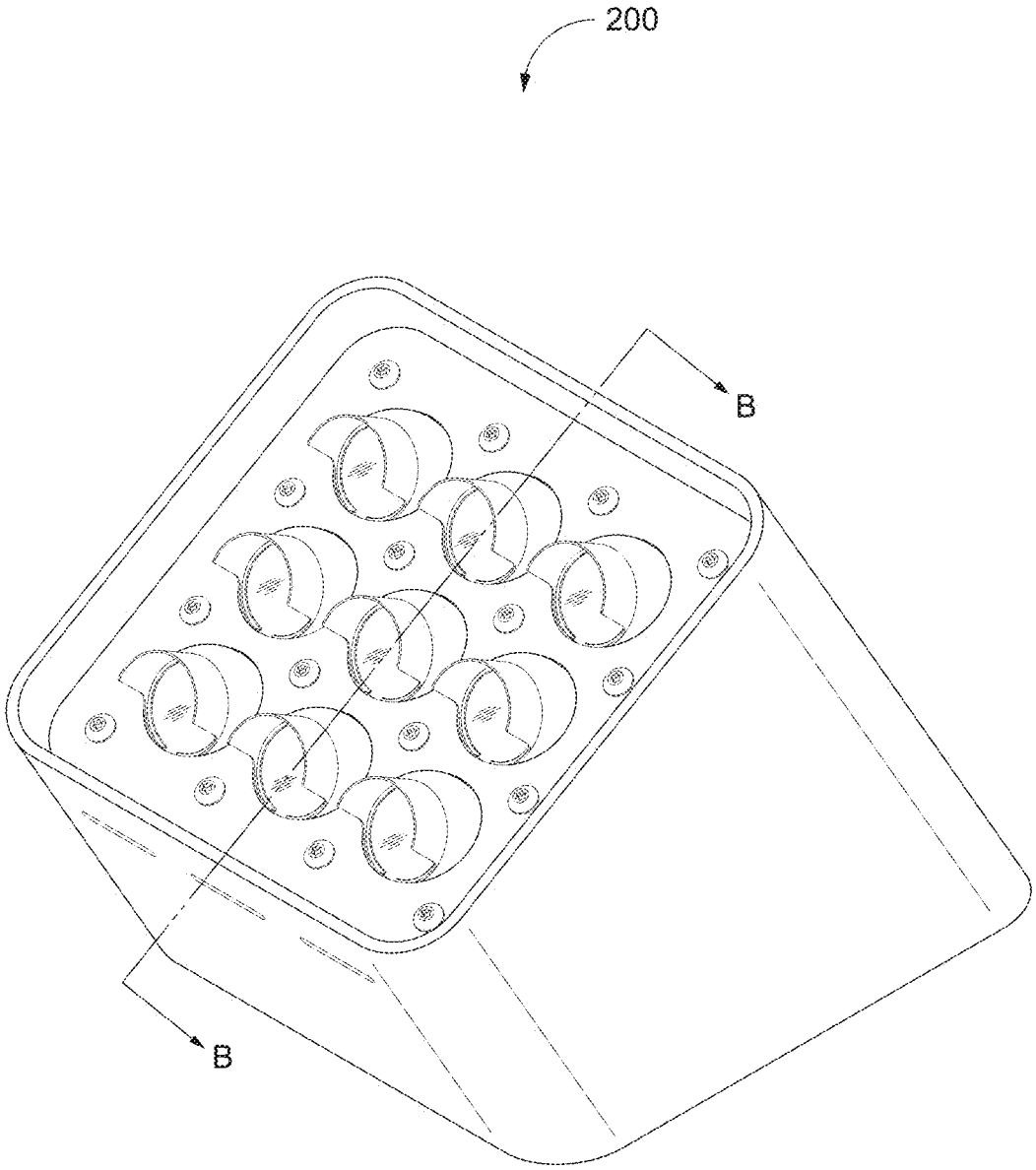
FIGS. 9-10 illustrate various views of a front-mount LED lighting fixture employing a plurality of the LED module of FIGS. 1-8.
Figure 10:
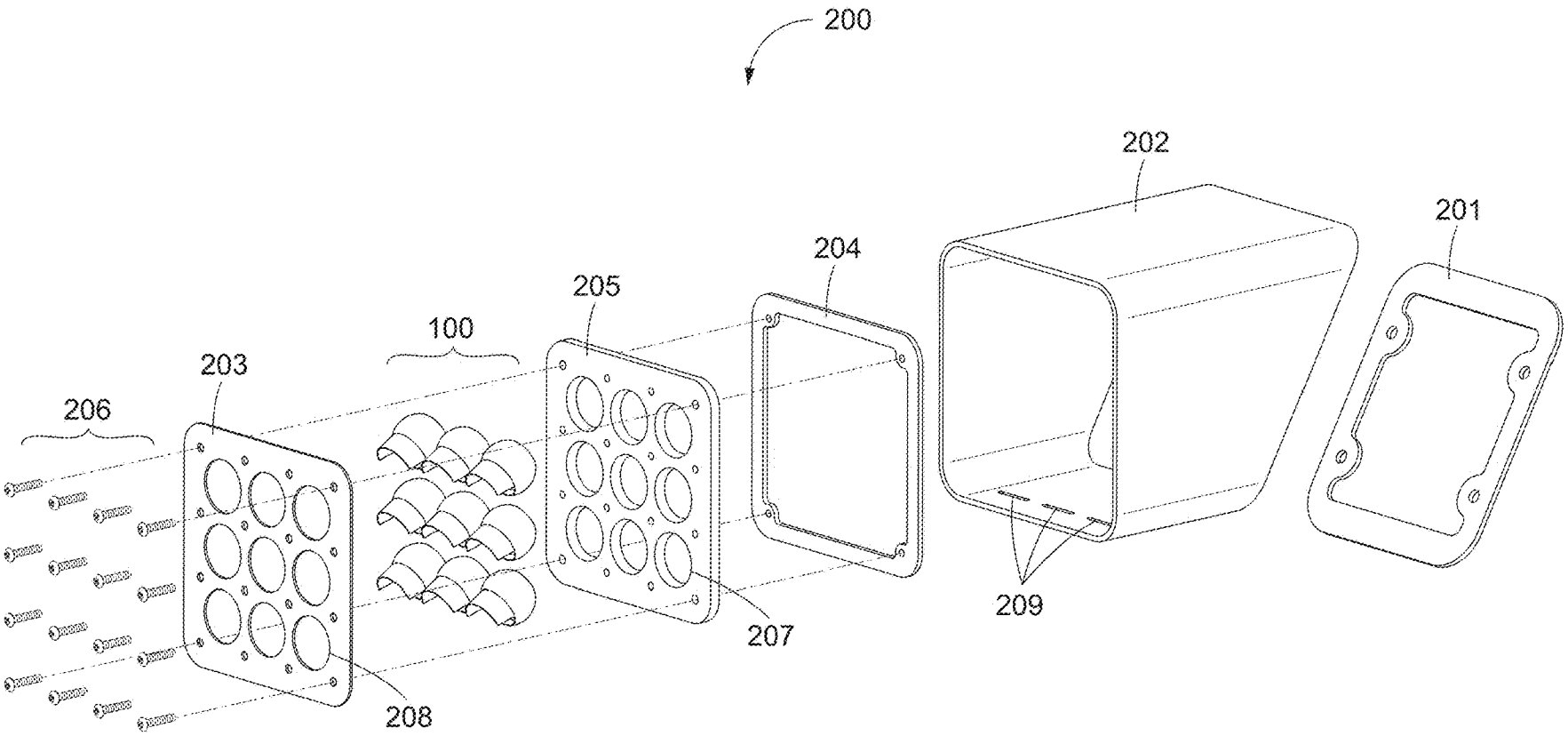

A method of lighting according to aspects of the invention comprises a lighting designer developing a lighting system including one or more lighting fixtures, each fixture including one or more of LED module 100 in order to create a lighting effect according to some combination of subjective/aesthetic considerations and objective requirements such as minimum lighting levels. For one example, FIGS. 9 and 10 illustrate an LED lighting fixture 200 employing nine LED modules 100 and designed for a ground-mounted lighting application (e.g., facade lighting); see also FIG. 12.

Fixture 200 (FIGS. 9 and 10) generally comprises a base 201 for bolting or otherwise affixing to a concrete pad, pole, sidewalk, or other mounting surface. Base 201 is welded or otherwise affixed to the interior surface of fixture housing 202. Housing 202 comprises an angled back relative the ground to direct light from LED modules 100 upward (see FIG. 12 for operational orientation), and slots 209 for draining moisture or ventilating interior components. The LED modules 100 could be powered from a line power or battery power. Housing 202 may house and secure from damage or theft any drivers, power regulating or other devices, wire harnesses, etc.

Figure 12:
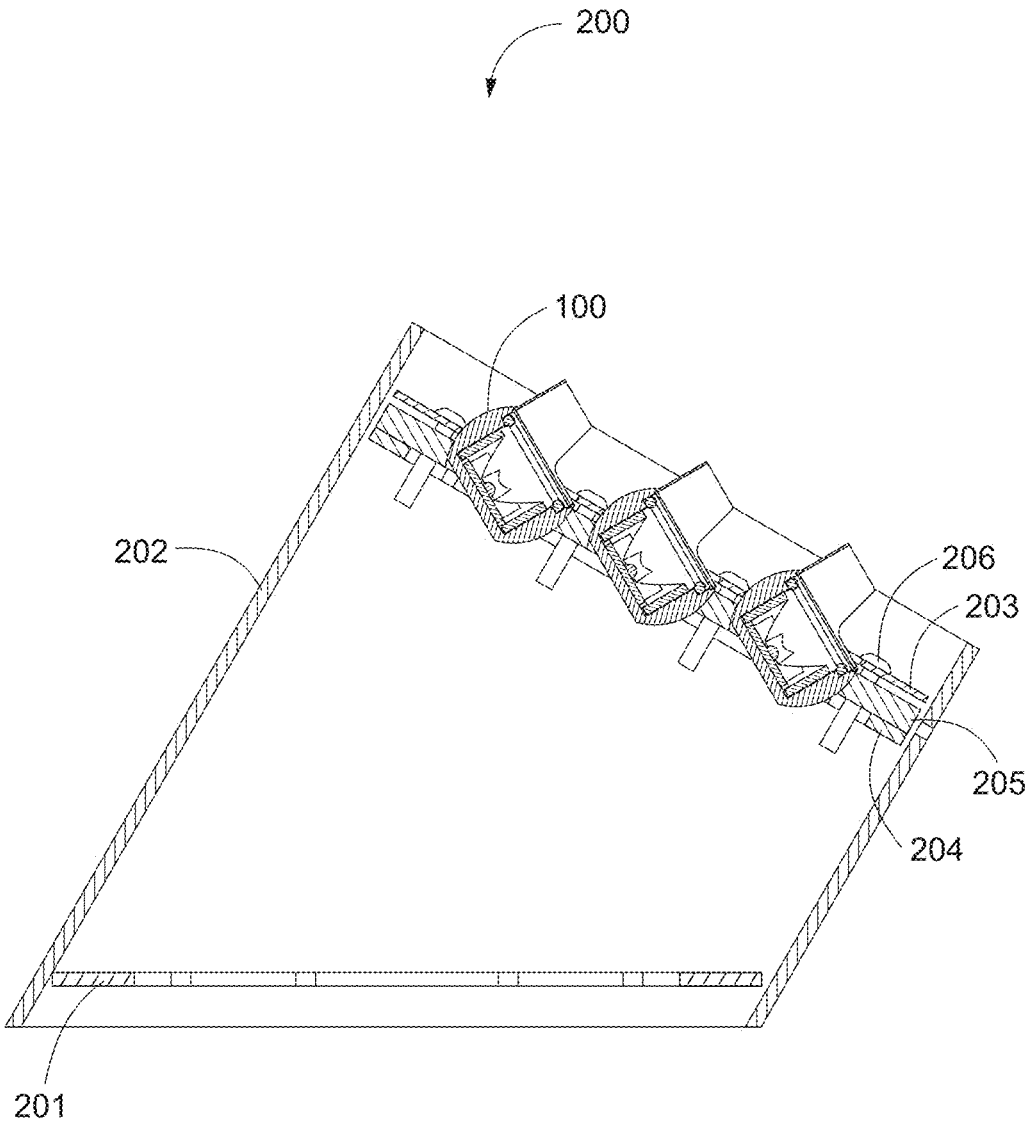
FIG. 12 illustrates a section view of fixture 200 taken along line B-B of FIG. 9 and rotated so to illustrate the fixture as it would appear when ground mounted.

LED fixture 200 further comprises an intermediate mounting plate 204 which is welded or otherwise affixed to the interior surface of fixture housing 202; see also FIG. 12. A first plate 205 is affixed to intermediate mounting plate 204 and includes spheroid openings 207 to receive housing 101 of each LED module 100. Openings have an initial diameter approximating dimension H (FIG. 4) and follow the curvature of module housing 101 to receive modules 100 such that modules cannot completely pass through said openings. By closely matching the curvature of module housing 101, good thermal transfer between modules 100 and plate 205 is ensured, thus providing a heat dissipation path from LEDs 105 to the ambient environment.

LED fixture 200 further comprises a second module plate 203 which compresses each LED module 100 against first module plate 205 when screws 206 are at least partially threaded through plates 203 and 205; screws 206 with tamper-proof heads could be used to further deter theft. Other fastening/clamping devices could be used as well. Each LED module 100 may be pivoted in any direction on the order of 45 degrees before light projected from a module would likely strike plate 203 and produce undesirable lighting effects. Third axis adjustability could be provided by rotating a module within its seated position in first module plate 205 or by rotating components internal to LED module 100 (i.e., rotating a module 100 around a central axis through its complementary opening in which it is seated). This is particularly useful for elliptical lenses and allows in situ rotation to provide significant flexibility in manipulating beam dimensions.

Note that the modules 100 functionally pivot about a center point concentric to the spheroid module and spheroid restraints formed by openings 207 and 208 in plates 203 and 205, thereby providing a very compact method of adjustment that limits interference between adjacent modules.

For installation, a lighting designer may bolt fixture 200 to a concrete pad or other structural feature or mounting surface of a target area. The lighting designer would then install plate 205, LED modules 100, and plate 203 (and at least some of screws 206). The lighting designer may rotate or pivot each module to produce an independently selectable aiming angle for each LED module 100. When a desired lighting effect is produced, plate 203 may be firmly clamped using screws 206 to hold modules 100 at their respective positions. If lighting needs change, for example, to provide temporary colored lighting in accordance with the changing of the seasons, plate 203 could be removed by removing screws 206. Optics or entire modules could be switched out as needed. A diffuser or color gel could be applied directly to lens 103 or lens 108; alternatively, a diffuser or color gel could be added as a discrete component in LED module 100.

It should be noted that the above process could differ and not depart from aspects according to the present invention. For example, at least part of the above process could be completed at a factory prior to shipping given sufficient information about the lighting application and/or target area. In this case, module plate 205 could be designed or selected, LED modules could be designed, selected, and seated in plate 205, and second plate 203 could be clamped down prior to shipment. Pre-aimed subassembly 205/100/203 could be shipped to a site and bolted into intermediate mounting plate 204, which may already be a part of subassembly 201/202/204.

Note that LED fixture 200 does not require an external lens or transparent cover since each LED module is sealed, and since housing 202 allows for venting or draining of moisture or heated air. Also, most or all components of fixture may be thermally conductive (e.g. composed of aluminum, steel, zinc, thermally conductive plastic, etc.) to provide a heat dissipation path from LED to ambient environment. It may be desirable to anodize, coat, or otherwise weatherize components of LED fixture 200 to produce a fully ruggedized design.

C. Exemplary Method and Apparatus Embodiment 2

FIGS. 13A-16B and subparts illustrate various views of a further embodiment comprising a unit 1100 (FIG. 13A) for lighting suitable for mounting within a fixture or luminaire; itself comprising top and bottom mounting frames 1110 and 1111 respective, clamping bolts 1140, and LED modules 1113 (in this example four modules 1113).

Each LED module 1113 (FIGS. 13B, 14A-H, and 15), comprises LED capsule 1121 (FIG. 14H) and two mounting segments 1135. LED capsule 1121 comprises top capsule half 1125, bottom capsule half 1130, fasteners 1131 (FIG. 15), LED assembly 1115, and lens 1120. Fasteners 1131 are installed through holes 1133. Heads seat in counterbores 1132. Fasteners 1131 clamp capsule halves 1125 and 1130 together; however other fasteners or clamping means could be used.

LED assembly 1115 typically comprises electronics board 1116 and LED 1117, and LED power leads 1118 which are routed through lead holes 1119 in bottom capsule half 1130.

Note that in this embodiment, most components (other than, e.g., the actual LED, leads, and fasteners) are constructed of aluminum, which has excellent thermal conductivity. This allows heat from the LED module 1113 to be conducted to mounting frames 1110 and 1111, and from there to a heat sink (not shown) or directly to the atmosphere. Other materials such as copper, brass, steel, thermally conductive plastic, etc. could be used as long as their thermal conductivity provided sufficient ability to reject heat for the LEDs and power levels used.

Mounting frames 1110 and 1111 (FIGS. 13A-B) each have partial cylindrical grooves 1112 (two in this example) which mate with mounting segments 1135 of one or more modules 1113. Each module 1113 is basically seated between and pivots in grooves 1112 of frames 1110 and 1111 when assembled about its longitudinal central axis 1200. At least top mounting frame 1110 has one or more openings 1114 for light from the LEDs. Mounting frames 1110 and 1111 may be made identically or nearly identically if desired. The external convex curvature of each segment 1135 at least generally matches or is complementary to the concave curvature of a cylindrical groove 1112. This allows the assembled module 1113 to be rotated around its axis 1200 when between frames 1110 and 1111. The complementary nature of curvature of segments 1135 and corresponding groove 1112 captures and guides rotation around axis 1200 in an accurate and predictable manner. When frame 1111 is increasingly tightened to frame 1110 with screws 1140, each module 1113 would experience increasing clamping forces, which would also provide increasing frictional resistance to rotation of modules around axis 1200. This also ensures that a thermal path is provided from modules 1113 to frame sections 1110 and 1111, allowing heat from the LED to be rejected to a heat sink (not shown) or directly to the atmosphere.

Figure 13A:
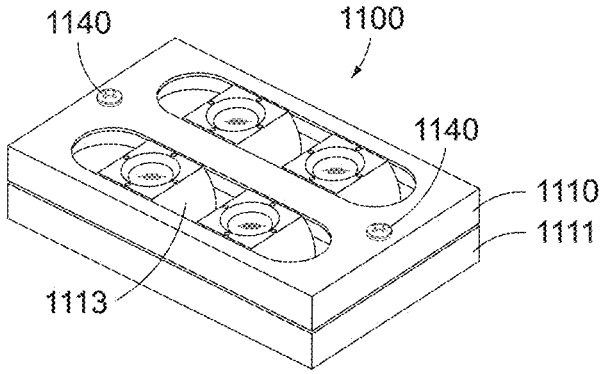
FIGS. 13A-B illustrate isometric and exploded isometric views, respectively, of a lighting unit according to aspects of the invention.
Figure 13B:
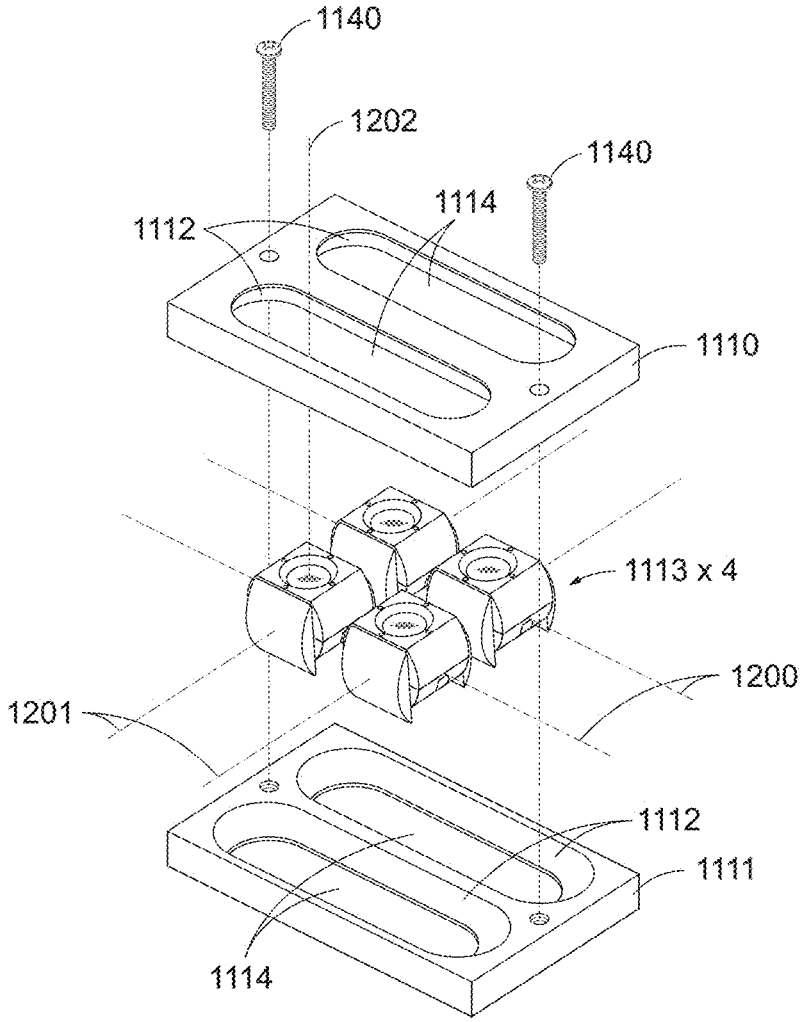
Figure 14A:
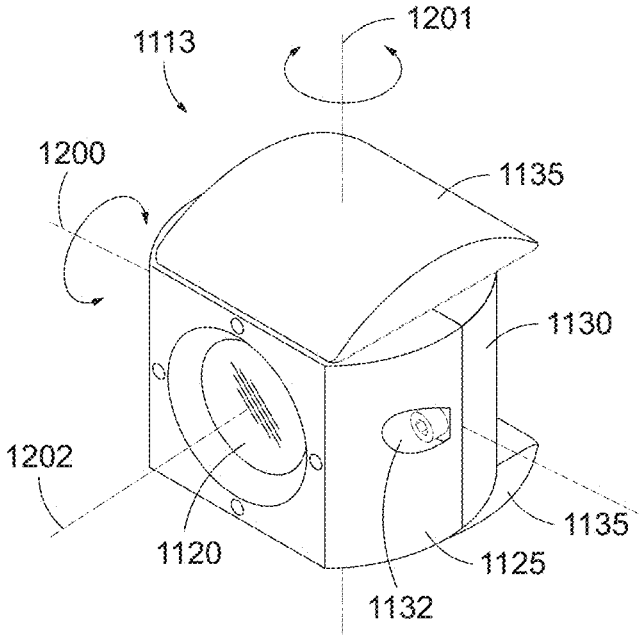
FIGS. 14A-H illustrate an LED module according to aspects of the invention in isometric and in front, back, left side, right side, top, bottom and exploded views respectively.
Figure 14B:
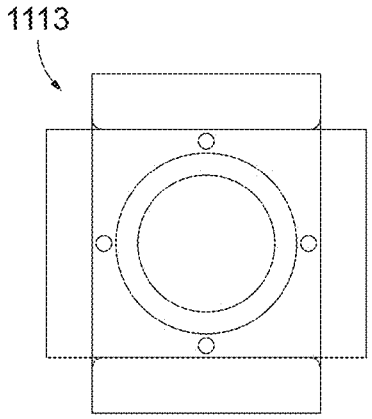
Figure 14C:
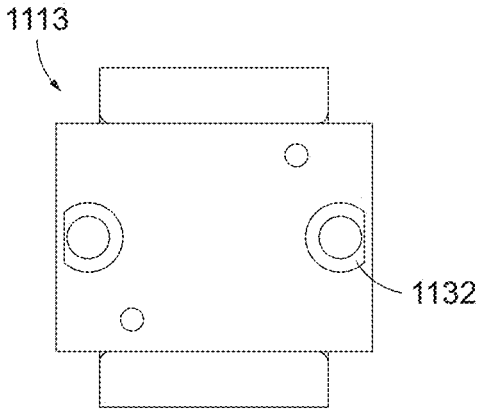
Figure 14D:
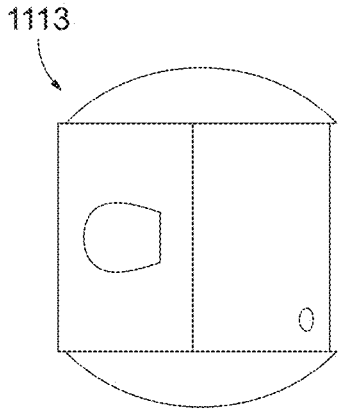
Figure 14E:
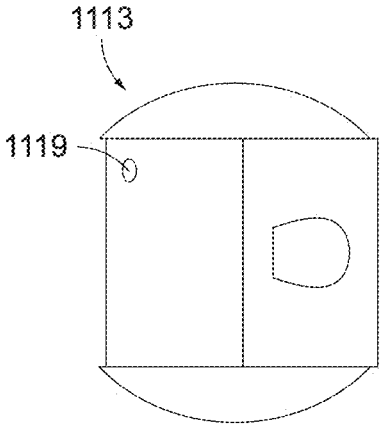
Figure 14F:
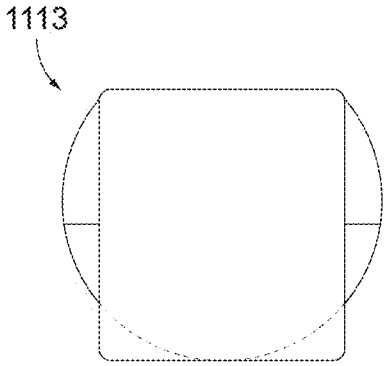
Figure 14G:
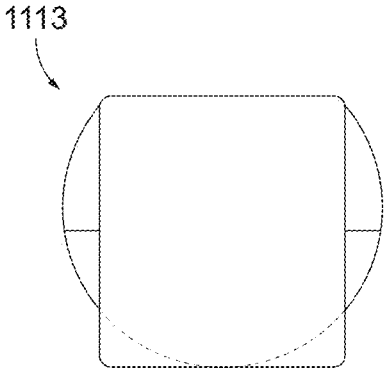
Figure 14H:
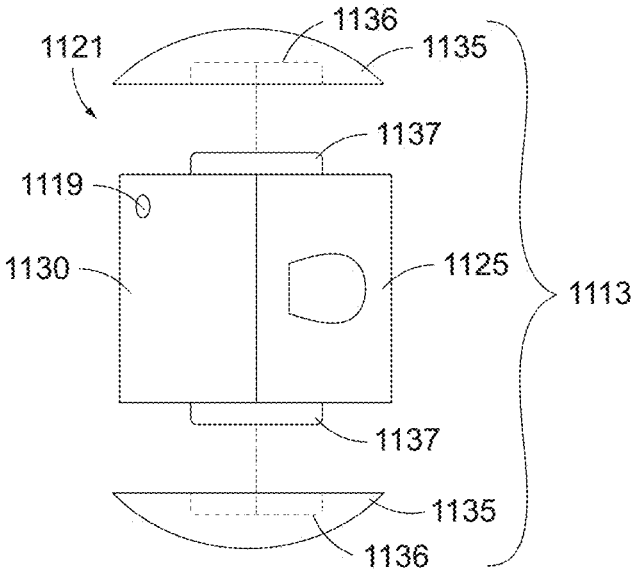
Figure 15:
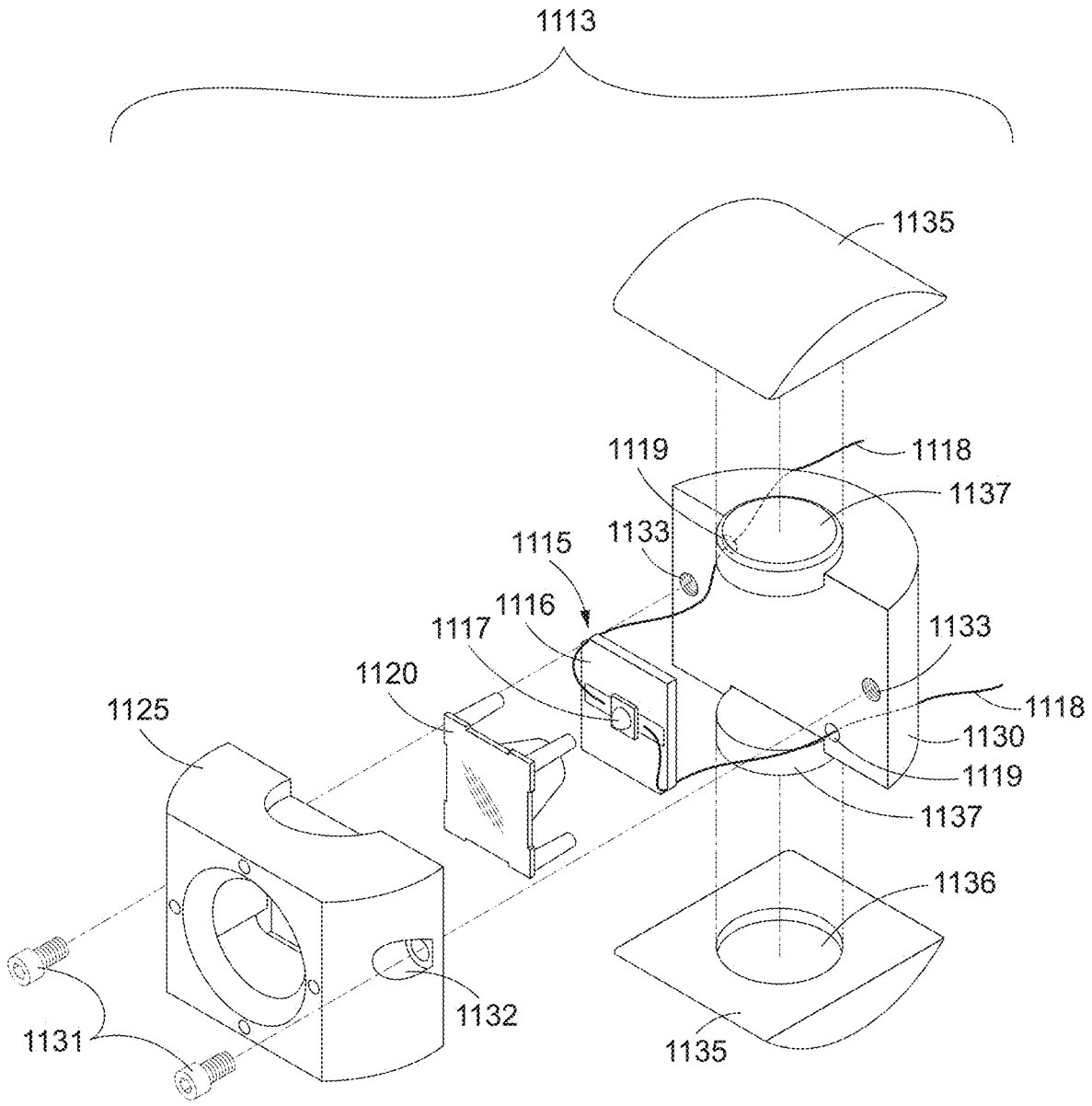
FIG. 15 illustrates an exploded isometric view of an LED module according to aspects of the invention.

Mounting segments 1135 (FIGS. 14H and 15) have a shallow bore 1136 (FIG. 14H and FIG. 15) which mate with cylindrical bosses 1137 (FIG. 15) on opposite ends of each LED capsule 1121 and which allow the capsule to rotate about crosswise central axis 1201 of each opening 1114 in frame 1110. (FIGS. 13B and 14A). Each set of central axes 1200 and 1201 are perpendicular with and approximately coplanar with each other. Further, they are perpendicular to LED optic axis 1202 (FIGS. 13B and 14A) through the center of LED assembly 1115, and approximately centered within LED module 1113. Each boss 1137 can be seated or otherwise be retained in bore 1136 of a mounting segment 1135 to resist lateral movement between boss 1137 and segment 1135, but allow rotation of capsule 1121 relative to each segment 1135. There could be a snap-fit, interference fit, or other type of frictional relationship so that segments 1135 on opposite sides of capsule 1121 could be seated in opposite frames 1110 and 1111, but capsule 1121 separately rotated or pivoted relative to axis 1201. With increasing convergence of frames 1110 and 1111 by tightening of screws 1140, increasing clamping forces are imposed between segments 1135 and bosses 1137, which would tend to provide increasing frictional resistance to rotation of capsule 1121 around axis 1201. But by having bosses 1137 captured in complementary bores 1136, capsule 1121 can have rotation around axis 1201 independently of and inside module 1113 in an accurate and predictable manner. This also ensures that a thermal path is provided from through the modules 1113 and to frame sections 1110 and 1111, allowing heat from the LED to be rejected to a heat sink (not shown) or directly to the atmosphere.

LED module 1113 is clamped between top and bottom mounting frames 1110 and 1111. The module is rotated about its two axes to aim the module. The mounting frames may be clamped more tightly together if necessary to maintain the aiming permanently or until re-aiming is desired.

Power leads 1118 (FIG. 15) are connected to a power source appropriate for the LED.

Multiple LED modules 1113 may be held between the top and bottom mounting frames 1110 and 1111. These may be in a single row or in multiple rows. Multiple modules may be installed in a dense array, allowing several adjustable light sources within a compact luminaire. The configuration of the modules is generally compact to allow multiple modules in a small space.

The modules 1113 can be on the order of less than one inch in any dimension. The compact configuration of the modules allows them to be assembled in luminaires which still allow the modules to be fully aimable (i.e. to rotate on axis 1200 and axis 1201) independently on the order of 30 to 45 degrees in both directions from their central point, and to be fully aimable independently of the rotation of the other modules within the luminaire. Further, this may be accomplished within a luminaire that may be as small as approximately 1.5 times the thickness and width of the enclosed modules (whether in a single row or two or more rows), and on the order of k+1.2k(n), where k is the length of module 1113 and n is the number of modules in a row (i.e. each module fits within about 1.2 times its length, with approximately an additional module length needed for the ends of the mounting frames). So a dual row package of six modules could be less than 1.5 in×4.75 in×3 in.

Figure 16A:
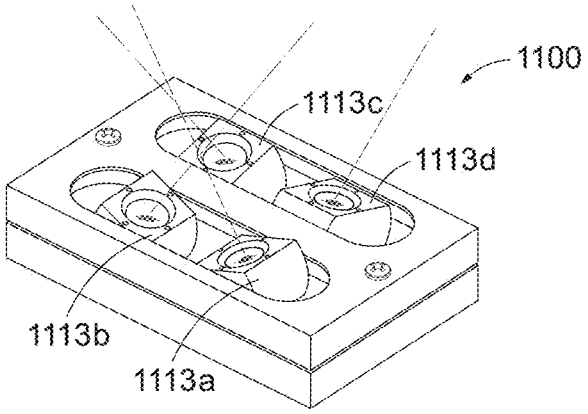
FIGS. 16A-B illustrate different adjustments or aimings of a lighting unit according to aspects of the invention.
Figure 16B:
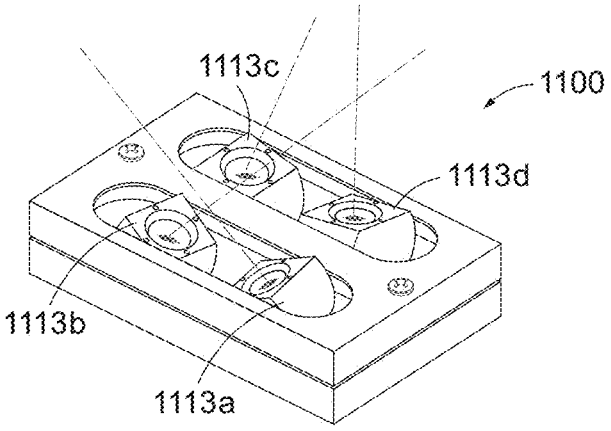

FIG. 16A illustrates a unit 1100 having four modules 1113*a-d* with each module rotated about one axis. FIG. 16B illustrates the same four modules rotated about two axes without interfering with each other.

D. Options and Alternatives

The invention may take many forms and embodiments. The preceding examples are but a few of those. Some exemplary options and alternatives are listed below.

As previously stated, flexible lighting design is particularly important for lighting applications that are temporary or exist to meet aesthetic needs. Note that a variety of lighting applications may benefit from embodiments of the invention. For example, permanent pathway lighting (also known in the art as pagoda lighting or bollard lighting) may have lighting needs change frequently. Walking or pedestrian paths can change due to buildings or development near a path. This could result in a need for less or more light, or for lighting to be redirected, for example. Thus a lighting application need not be temporary or according to aesthetic needs to benefit from embodiments of the present invention.

A number of additions, deletions, or changes could be made to fixture 200 and not depart from aspects according to the present invention. For example, to further deter theft, each module 100 could use silicone sealer in place of snap ring 102 and O-ring 106. This would limit the interchangeability of components within a single module 100, but an entire module could be readily switched out with another within fixture 200. As another example, each module 100 could include additional LEDs 105, depending on the needs of the lighting application such as, e.g., color temperature or minimum light level needed. Multi-die LEDs, multiple single die LEDs on a common board, and/or multiple colored LEDs could all be included in module 100. Likewise, the needs of the lighting application may require a wider or narrower beam from any given fixture 200 or module 100 to provide a final composite beam of desired dimensions. In such a case, optic 108 comprising a lens with a beam spread on the order of 18 degrees (FIG. 11A) could be replaced by optic 114 (FIG. 11B) comprising a reflector with a beam spread on the order of 4 degrees. Replacing one optic with another could necessitate a change to the design of holder 107, or could obviate the need for holder 107. Further, while FIGS. 11A and B illustrate custom lens 108 and reflector 114 respectively, a number of commercially available optics are available for use in module 100 including, for example, any of the FLP model of lenses or F4A series of white diffuse reflectors (both available from Fraen Corporation, Reading, Mass., USA). A number of models and designs of LEDs and optics are possible, and envisioned, and this selectivity and variety can vary from module to module (even between modules in the same fixture). Similarly, variations to fixture 1100 are possible.

Also, while specific methods of coupling components are discussed such as welding or using threaded screws in complementary threaded holes, other methods are possible and envisioned, such as the use of glue or solvents, or forming components from a single part. Likewise, removable clamps could be used, or parts could be tied together in place of threaded fasteners. Further, specific forming methods such as machining could be replaced by other methods such as molding, punching or rolling. Both the methods of forming parts, as well as the methods of coupling parts, could differ from those described herein and not depart from at least some aspects of the present invention.

It can therefore be seen that the embodiments disclosed above relate to the concept of at least a partial ball-in-socket relationship between bodies holding at least one LED source. The body can include interchangeable and selectable lenses or optical components as well as LED sources. The body can have an exterior that allows rotation, at least over some partial or range of the whole LED subassembly as well as rotation of that subassembly around an LED aiming axis. This can assist in giving at least some highly adjustable range of individual aiming of individual LED subassemblies relative the housing of the fixture as well as rotation of those subassemblies around the LED aiming axis. This latter function can allow additional flexibility such as with positioning of a visor on the body relative to the light output from the LED subassembly or other functions. As can be appreciated, embodiment one has an LED sub-assembly body that is almost completely spherical. It can therefore rotate within a receiver having a seat defined by an edge. That edge can be simply the perimeter of a circular opening in a plate. That opening is essentially a seat and bearing surface for rotation of that substantially spherical body. On the other hand, embodiment two shows a different form factor body or capsule. Four different convex segments are positioned around that body. Those convex segments work in an analogous fashion to a spherical exterior in the sense that it allows rotation, at least over a range, of the capsule in a beveled slot. This includes not only changing of the angular orientation of the LED aiming axis from the body or capsule relative to the housing but also rotation of the entire body or capsule around that aiming axis. As further illustrated in the embodiments, some sort of removable member can fix or clamp the LED subassemblies in their receivers or receiver once they are rotated to a selected position. This allows high customization and adjustability of the light output compositely from a plurality of LED subassemblies while allowing easy interchangeability and readjustment at a later time.

What is claimed is:

1. An LED lighting apparatus comprising:

a. a housing;

b. a plurality of LED subassemblies in the housing;

c. each LED subassembly comprising:

i. a body with an exterior and an opening into an interior space;

ii. at least one LED light source in the interior space of the body, the LED light source having a fixed aiming axis relative to the body;

iii. an optic associated within the at least one LED light source, said optic comprising one of:

1. a lens adapted to modify light from the at least one LED light source to produce a desired beam spread: or 2. a reflector adapted to reflect light from the at least one LED light source:

iv. a lens adapted to removably seal the opening, of the body;

v. a snap rings adapted to removably compress the lens against the body thereby removably sealing the opening of the body;

vi. a visor at the exterior of the body adapted to absorb at least a portion of the modified light output of the LED light source;

vii. a receiver comprising a seat for the body;

viii. the body and the seat having at least a partial ball-in-socket relationship allowing the aiming axis of each said LED light source to be individually adjusted relative to the housing of the apparatus as well as rotated about its aiming axis by rotation of the body in the seat;

d. a removable locking member insertable over the LED subassemblies to fix the LED subassemblies in rotation position in their seats in their housing, wherein the removable locking member comprises a plate that clamps the LED subassemblies in place; and e. thereby allowing individual selection, installation or substitution, aiming, and fixing of each LED subassembly in the housing.

2. The LED lighting apparatus of claim 1 wherein:

a. the seat of the receiver is complementary to at least a portion of the exterior of the body of the LED subassembly;

b. one of the body and the seat comprising at least part of the surfaces of a ball; and c. the other of the body and the seat comprising at least an edge in a plane that seats and allows rotation of the body over a range.

3. The LED lighting apparatus of claim 2 wherein the exterior of the body is substantially spherical.

4. The LED lighting apparatus of claim 3 wherein the seat is a circular opening for each body.

5. The LED lighting apparatus of claim 2 wherein the exterior of the body comprises segments with convex sections distributed around the body.

6. The LED lighting apparatus of claim 2 wherein the seat is a beveled slot for plural bodies.

7. The LED lighting apparatus of claim 1 wherein the housing includes a generally hollow interior portion, and further comprising:

a. one or more power regulating devices in the generally hollow interior portion of the housing; and b. one or more vents in the housing adapted to vent heated air or moisture from the housing.

8. The LED lighting apparatus of claim 1 wherein the housing further comprises a structure for positionally affixing the housing relative to a mounting surface.

* * * * *